US006133881A

United States Patent [19]

Kushihi et al.

[11] Patent Number: 6,133,881

[45] **Date of Patent: *Oct. 17, 2000**

[54] SURFACE MOUNT ANTENNA AND COMMUNICATION APPARATUS INCLUDING THE SAME

[75] Inventors: Yuichi Kushihi, Ishikawa-ken; Masaru Shikata, Kanazawa, both of Japan

[73] Assignee: Murata Manufacturing Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/211,104

[22] Filed: Dec. 15, 1998

[30] Foreign Application Priority Data

Dec. 19, 1997 [JP] Japan ..... 9-350445
Oct. 15, 1998 [JP] Japan ..... 10-293459

[51] Int. Cl.[7] ..... H01Q 1/38

[52] U.S. Cl. ..... 343/700 MS; 343/702; 343/846; 343/895

[58] Field of Search ..... 343/700 MS, 702, 343/845, 895, 873, 825, 829, 857, 848

[56] References Cited

U.S. PATENT DOCUMENTS

| | | | |
|---|---|---|---|
| 4,367,474 | 1/1983 | Schaubert et al. | 343/700 MS |
| 5,696,517 | 12/1997 | Kawahata et al. | 343/700 MS |
| 5,748,149 | 5/1998 | Kawahata et al. | 343/700 MS |
| 5,760,746 | 6/1998 | Kawahata et al. | 343/702 |
| 5,854,606 | 12/1998 | Kawahata et al. | 343/702 |
| 5,861,854 | 1/1999 | Kawahata et al. | 343/702 |
| 5,867,126 | 2/1999 | Kawahata et al. | 343/702 |
| 5,903,240 | 5/1999 | Kawahata et al. | 343/700 MS |

FOREIGN PATENT DOCUMENTS

| | | |
|---|---|---|
| 0766341 | 4/1997 | European Pat. Off. . |
| 0767510 | 4/1997 | European Pat. Off. . |
| 2227370 | 7/1990 | United Kingdom . |

*Primary Examiner*—Don Wong
*Assistant Examiner*—Shih-Chao Chen
*Attorney, Agent, or Firm*—Ostrolenk, Faber, Gerb & Soffen, LLP

[57] ABSTRACT

A surface mount antenna having a substrate made of at least one of a dielectric material and a magnetic material, the substrate having a substantially rectangular prism shape and including a first major surface and a second major surface; a ground electrode disposed on the first major surface of the substrate; a radiation electrode having a strip shape disposed at least on the second major surface of the substrate; a feeding electrode disposed on at least one surface of the substrate; and the radiation electrode including an open end portion and a plurality of grounded end portions, the open end portion being arranged close to the feeding electrode with a gap therebetween on the substrate, and the plurality of the grounded end portions being connected to the ground electrode on different portions of the substrate, respectively. The above described antenna has an enhanced gain without changes in size.

4 Claims, 3 Drawing Sheets

SURFACE MOUNT ANTENNA AND COMMUNICATION APPARATUS INCLUDING THE SAME

BACKGROUND OF THE INVENTION

1. Industrial Field of the Invention

The present invention relates to a surface mount antenna and a communication apparatus including the same.

2. Description of the Related Art

FIG. 4 shows a conventional surface mount antenna. The basic configuration of the surface antenna is stated in Japanese Unexamined Patent Publication No. 9-098015. In the surface mount antenna 1 shown in FIG. 4, a ground electrode 3 is provided on a first major surface 2*a* of a substrate 2 made of a dielectric such as a ceramic, a resin, and the like, having a substantially rectangular prism shape. A strip radiation electrode 4 is provided on a second surface 2*b*. A feeding electrode 5 is provided on the first major surface 2*a*, turning to and elongating on one end surface of the substrate 2. The radiation electrode 4 is provided on substantially the entire surface of the second major surface 2*b* of the substrate 2, in a straight strip shape. In one end of the radiation electrode 4, an open end portion 4*a* is so provided as to extend and turn to the end surface in which the feeding electrode 5 is provided, till it is close to the feeding electrode 5 through a gap 6. In the other end of the radiation electrode 4, a grounded end portion 4*b* is so provided as to extend and turn to and on the end surface of the substrate 2 in which the feeding electrode 5 is provided, till it gets into contact with the ground electrode 3.

With the above configuration of the surface mount antenna 1, a high frequency signal, inputted into the feeding electrode 5, is transmitted to the radiation electrode 4 through a static capacitance produced in the gap 6 between the open end portion 4*a* of the radiation electrode 4 and the feeding electrode 5. The radiation electrode 4 of which one end is open and the other end is short-circuited, having a length of about $\lambda/4$ becomes resonant as a microstrip line resonator. With the resonance, a part of an electric field energy generated between the radiation electrode 4 and the ground electrode 3 is radiated into space. Thus, the surface mount antenna 1 acts as an antenna. In FIG. 4. J1 designates an electric current flowing in the radiation electrode 4.

In a microstrip line resonator with a length of about $\lambda/4$ such as the surface mount antenna 1, a current flowing there is maximum in the grounded end portion 4*b*. The grounded end portion 4*b* is so provided as to be narrow in width, as compared with the other part of the radiation electrode 4. Therefore, the current density in the grounded end portion 4*b* is higher than the other part of the radiation electrode 4. Accordingly, the conductor loss of the radiation electrode 4 is maximum in the grounded end portion 4*b*.

FIG. 5 is a side view showing the end surface of the surface mount antenna 1 where the feeding electrode 5, the open end portion 4*a* of the radiation electrode 4, and the grounded end portion 4*b* are provided. As shown in FIG. 5, the current J1 flows in the grounded end portion 4*b* of the radiation electrode 4, concentratedly in the side of the grounded end portion 4*b* which is relatively near to the open end portion 4*a*, since the current J1 has a tendency to flow from the feeding electrode 5 to the ground electrode 3 a shortest distance, due to its electromagnetic characteristics.

As described above, the maximum current flowing in the radiation electrode 4 is concentrated in the side of the narrow grounded end portion 4*b* which is relatively near to the open end portion 4*a*. Therefore, the conductor loss in the above-mentioned side of the grounded end portion 4*b* is high, which causes the antenna gain to decrease.

It is thinkable that the width of the grounded end portion 4*b* is widened as measures for reducing the conductor loss. Even if the grounded end portion 4*b* is widened, a current flows concentratedly in the side of the grounded end portion 4*b* which is relatively close to the open end portion 4*a*. Accordingly, the antenna gain can not be improved. By widening the grounded end portion 4*b* of the radiation electrode 4, the distance between the grounded end portion 4*b* and the open end portion 4*a* becomes short. That is, the substantial length of the radiation electrode is shortened, causing the resonance frequency to increase. In order to restore the resonance frequency, it is necessary to lengthening the substrate 2 and the radiation electrode 4.

SUMMARY OF THE INVENTION

Preferred embodiments of the present invention is provided to overcome the above described problems, and provide a surface mount antenna of which the antenna gain can be enhanced without changes in the size of the antenna, and a communication apparatus including the same.

The preferred embodiment of the present invention provides a surface mount antenna, comprising: a substrate made of at least one of a dielectric material and a magnetic material, said substrate having a substantially rectangular prism shape and including a first major surface and a second major surface; a ground electrode disposed on said first major surface of said substrate; a radiation electrode having a strip shape disposed at least on said second major surface of said substrate; a feeding electrode disposed on at least one surface of said substrate; and said radiation electrode including an open end portion and a plurality of grounded end portions, said open end portion being arranged close to said feeding electrode with a gap therebetween on said substrate, and said plurality of grounded end portions being connected to said ground electrode on different portions of the substrate, respectively.

In the above described surface mount antenna, said plurality of grounded end portions may be connected to said ground electrode on different end surfaces of the substrate, respectively.

The preferred embodiment of the present invention provides a communication apparatus including the above described surface mount antenna.

According to the above described surface mount antenna, a plurality of branched grounded end portions are so provided in the other end of the radiation electrode as to elongate on the different end surfaces of the substrate to be connected to the ground electrode, respectively. Accordingly, a current flowing in the respective grounded end portions of the radiation electrode is reduced with the current density and the conductor loss. Thereby, the antenna gain of the surface mount antenna can be improved without changes in the size of the antenna.

And, according to the above described communication apparatus, the communication quality can be enhanced, and the expense of the communication apparatus excepting the antenna can be saved.

Other features and advantages of the present invention will become apparent from the following description of preferred embodiments of the invention which refers to the accompanying drawings, wherein like reference numerals indicate like elements to avoid duplicative description.

DETAILED DESCRIPTION OF THE PREFERRED EMBODIMENTS

Figure 1:
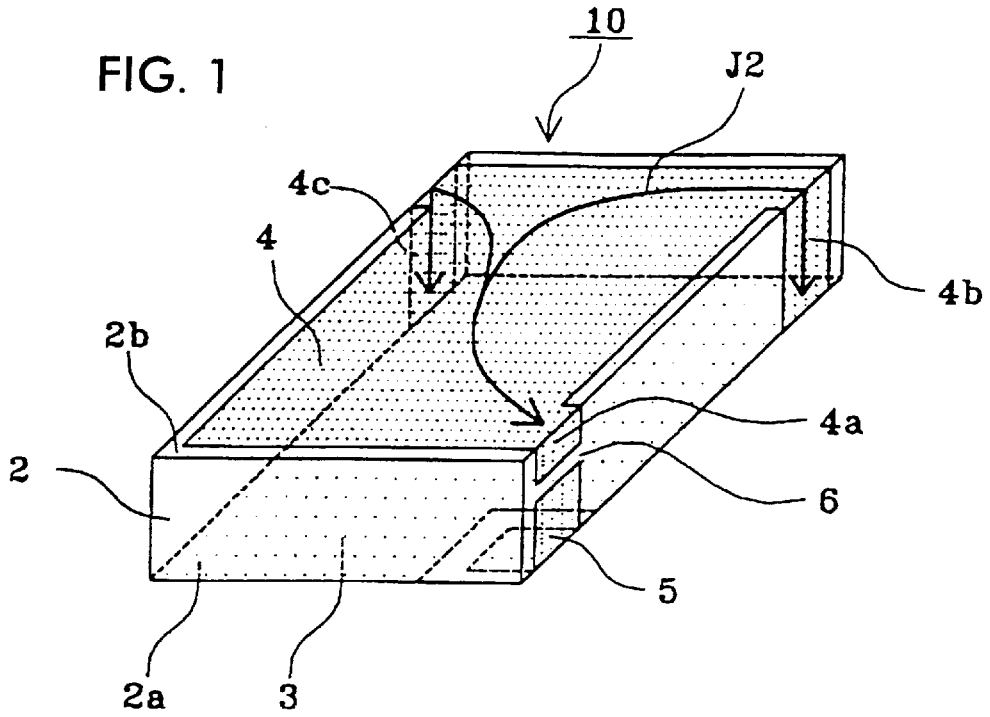
FIG. 1 is a perspective view of a surface mount antenna according to a preferred embodiment of the present invention.

FIG. 1 shows a surface mount antenna according to a preferred embodiment of the present invention. In FIG. 1, two branched-portions as grounded end portions 4*b*, 4*c* are so provided in the other end of the radiation electrode 4 of the surface mount antenna 10 as to elongate on the opposite end surfaces of the substrate and be connected to the ground electrode 3, respectively. In FIG. 1, J2 designates an electric current flowing in the radiation electrode 4.

As described above, the branched grounded end portions 4*b*, 4*c* of the radiation electrode 4 are provided on the two opposite end surfaces of the substrate 2. A current, though it conventionally flows only through the grounded end portion 4*b*, is divided and flows through both of the grounded end portion 4*b*, 4*c*. The current density in the respective grounded end portions becomes about half as compared with the case of the current flowing through only one grounded end portion. Thus, the conductor loss in the respective grounded end portions 4*b*, 4*c* is reduced, and the antenna gain of the surface mount antenna 10 is improved. In addition, the grounded end portion 4*b* of the surface mount antenna 10 is in the same position as that of the surface mount antenna 1, and the grounded end portion 4*c* is provided in the opposite position to the grounded end portion 4*b*. Thus, the distances between the open end portion 4*a* and the grounded end portion 4*b* and between the open end portion 4*a* and the grounded end portion 4*c* are prevented from becoming short. Thus, even though the surface mount antenna 10 has the same size as the conventional surface mount antenna 1, the resonance frequency can be prevented from changing significantly.

Figure 2:
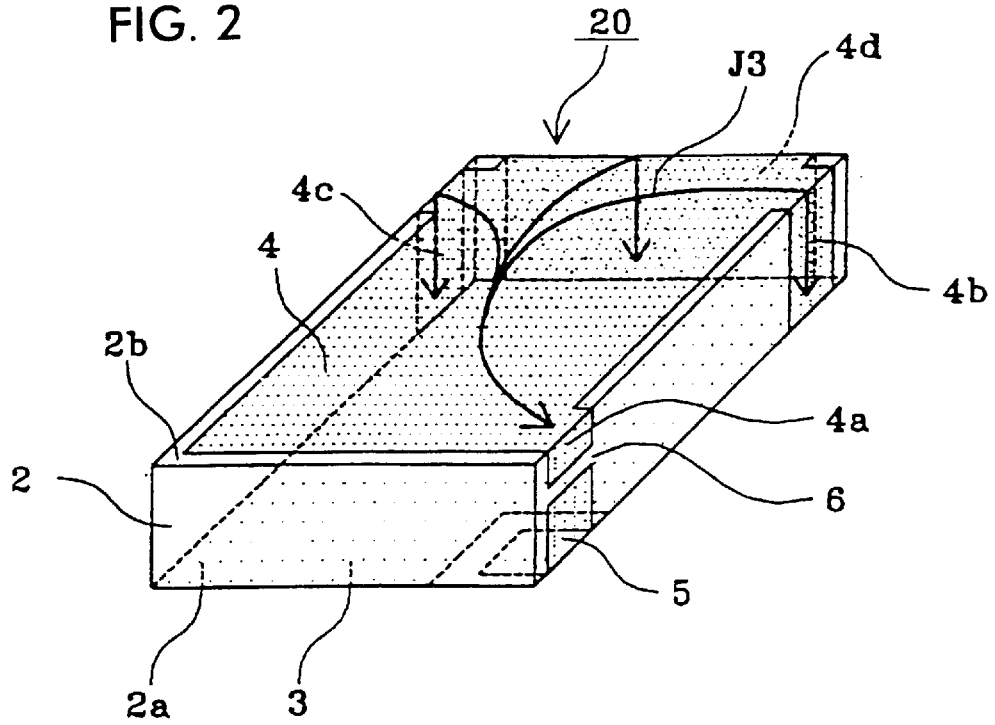
FIG. 2 is a perspective view of a surface mount antenna according to another preferred embodiment of the present invention.

FIG. 2 shows a surface mount antenna according to another preferred embodiment of the present invention. As shown in FIG. 2, three branched portions as grounded end portions 4*b*, 4*c*, and 4*d* are so provided in the other end of the radiation electrode 4 of the surface mount antenna 20 as to elongate on three different end surfaces of the substrate 2 to be connected to the ground electrode 3. In FIG. 2, J3 designates an electric current flowing through the radiation electrode 4.

In the surface mount antenna 20 as described above, by branching the grounded end of the radiation electrode 4 into three portions 4*b*, 4*c*, and 4*d*, currents flowing in the respective end portions 4*b*, 4*c*, and 4*d* can be more decreased as compared with the case of the surface mount antenna 10 as shown in FIG. 1, and thereby, the conductor loss can be further reduced. The antenna gain is enhanced.

As a result of the experiment, it was shown that in the case of the substrates having the same size, the surface mount antenna 10, 20 had antenna gains enhanced by 0.2 dB, 0.7 dB as compared with the surface mount antenna 1, respectively. Thus, the improvement of the antenna gain has been confirmed.

In the above-described respective embodiments, the radiation electrode is provided in a wide straight shape. However, the radiation electrode may have another shape such as a L-letter shape, U-letter shape, a meander shape, or the like. In the above-described embodiments, the substrate of the surface mount antenna is made of a dielectric. However, for the substrate, magnetic material such as ferrite and the like may be used.

Figure 3:
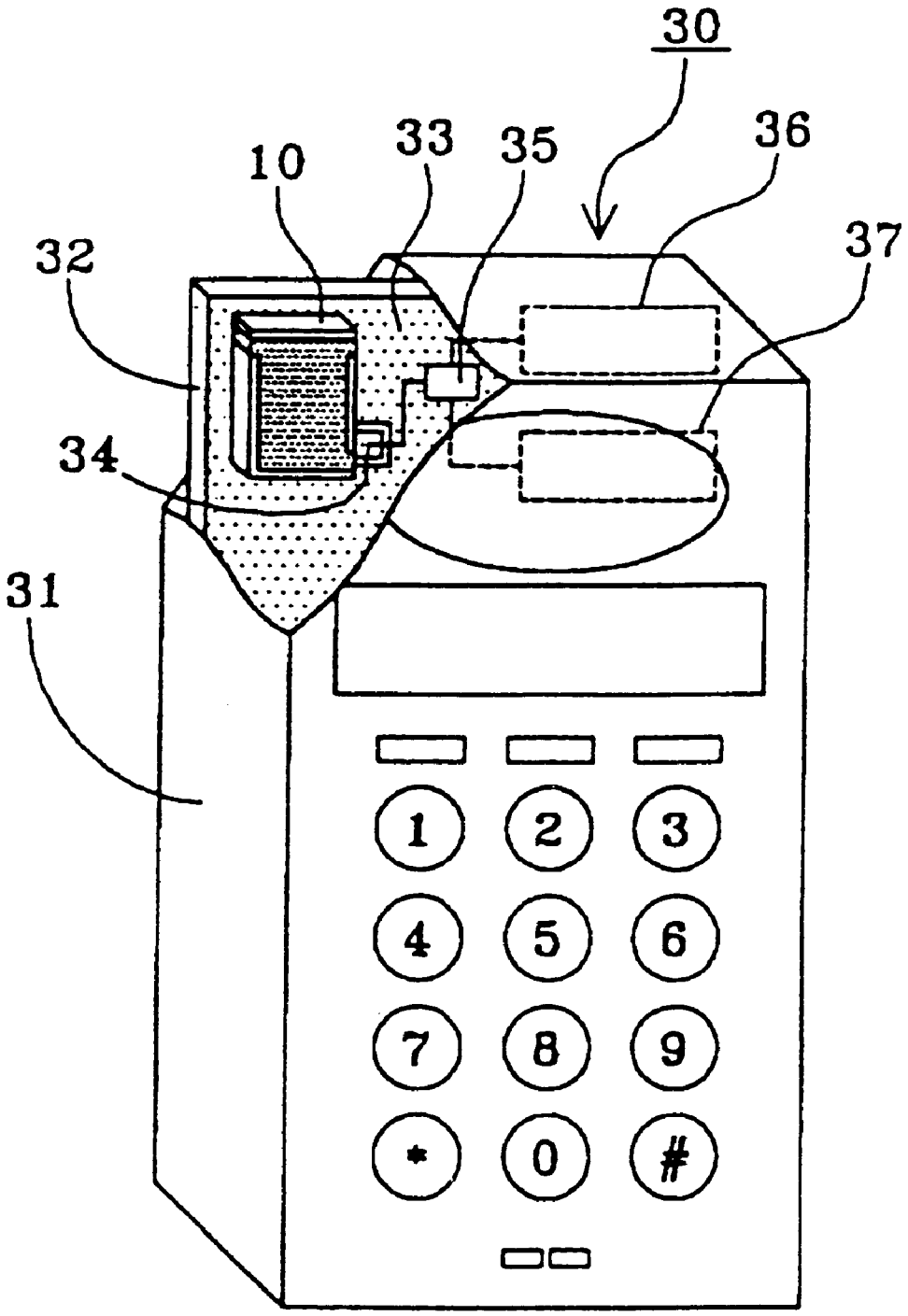
FIG. 3 is a perspective view of a communication apparatus according to a preferred embodiment of the present invention.
Figure 4:
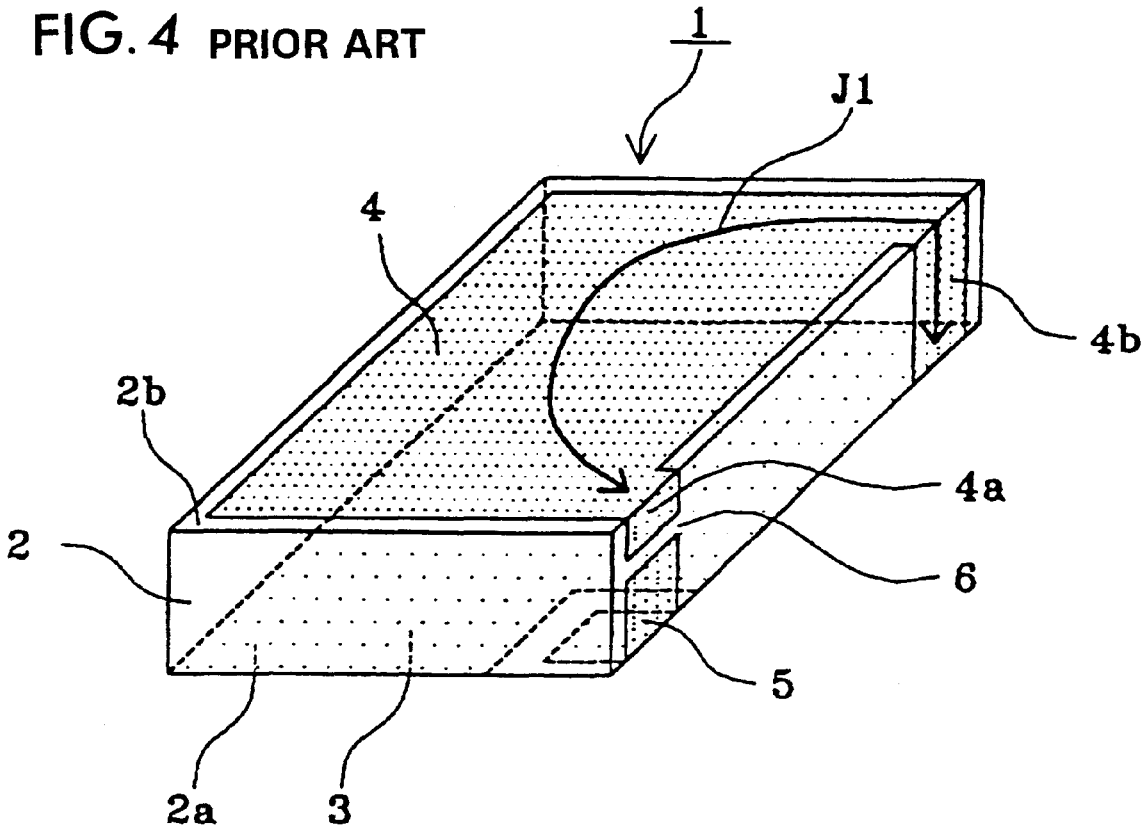
FIG. 4 PRIOR ART
FIG. 4 is a perspective view of a conventional surface mount antenna.
Figure 5:
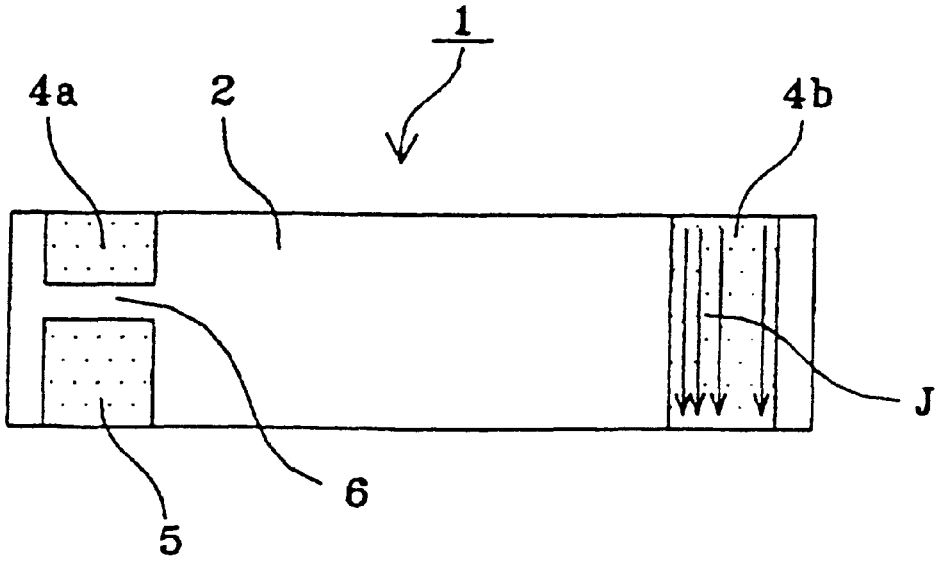
FIG. 5 PRIOR ART
FIG. 5 is a side view of a grounded end portion of the conventional surface mount antenna, in which a current distribution is illustrated.

FIG. 3 shows a communication equipment including the surface mount antenna 10 of the present invention. As regards a communication apparatus 30 shown in FIG. 3, a mounting substrate 32 is provided in a case 31. On the mounting substrate 32, a ground electrode 33 and a feeding line 34 are provided. The surface mount antenna 10 is mounted in a corner of the mounting substrate 32. The feeding terminal (not shown) of the surface mount antenna 10 is connected to the feeding line 34 of the mounting substrate 32. The feeding line 34 is connected to a transmitting circuit 36 and a receiving circuit 37 provided on the mounting substrate 32, through a change-over circuit 35 provided on the mounting substrate 32.

As seen in the above description, the communication apparatus 30, using the surface mount antenna 10, has an improved antenna gain. Accordingly, the communication apparatus 30 has high anti-noise properties, and communication can be achieved on a low signal level. That is, the communication quality is enhanced. On the other hand, specifications of NF (noise factor) of a filter and a mixer, and the C/N ratio (noise ratio) of an oscillator in the communication apparatus may be slacked in consideration of the improved gain. Thus, the cost of components except the antenna can be lowered. Thus, the total expense of the communication apparatus 30 can be saved.

In the embodiment as shown in FIG. 3, the communication apparatus 30 is constructed by using the surface mount antenna 10 as shown in FIG. 1. The communication apparatus provided configured by using the surface mount antenna 20 as shown in FIG. 2 presents the same operation/working-effect as one containing the surface mount antenna 10.

While the invention has been particularly shown and described with reference to preferred embodiments thereof, it will be understood by those skilled in the art that the forgoing and other changes in form and details may be made therein without departing from the spirit of the invention.

What is claimed is:

1. A surface mount antenna, comprising:

a substrate comprising at least one of a dielectric material and a magnetic material, said substrate having a substantially rectangular prism shape and including a first major surface and a second major surface;

a ground electrode disposed on said first major surface of said substrate;

a radiation electrode having a strip shape disposed at least on said second major surface of said substrate and resonating at a single resonant frequency;

a feeding electrode disposed on at least one surface of said substrate; and said radiation electrode including an open end portion and a plurality of grounded end portions, said open end portion being arranged close to said feeding electrode with a gap therebetween on said substrate, and said plurality of grounded end portions being connected to said ground electrode on different portions of the substrate, respectively.

2. The surface mount antenna according to claim 1, wherein said plurality of grounded end portions are connected to said ground electrode on different end surface of the substrate, respectively.

3. A communication apparatus having a surface mount antenna, the surface mount antenna comprising a substrate comprising at least one of a dielectric material and a magnetic material, said substrate having a substantially rectangular prism shape and including a first major surface and a second major surface;

a ground electrode disposed on said first major surface of said substrate;

a radiation electrode having a strip shape disposed at least on said second major surface of said substrate and resonating at a single resonant frequency;

a feeding electrode disposed on at least one surface of said substrate; and said radiation electrode including an open end portion and a plurality of grounded end portions, said open end portion being arranged close to said feeding electrode with a gap therebetween on said substrate, and said plurality of grounded end portions being connected to said ground electrode on different portions of the substrate, respectively.

4. A communication apparatus having a surface mount antenna, the surface mount antenna comprising a substrate comprising at least one of a dielectric material and a magnetic material, said substrate having a substantially rectangular prism shape and including a first major surface and a second major surface;

a ground electrode disposed on said first major surface of said substrate;

a radiation electrode having a strip shape disposed at least on said second major surface of said substrate and resonating at a single resonant frequency;

a feeding electrode disposed on at least one surface of said substrate; and said radiation electrode including an open end portion and a plurality of grounded end portions, said open end portion being arranged close to said feeding electrode with a gap therebetween on said substrate, and said plurality of grounded end portions being connected to said ground electrode on different portions of the substrate, respectively;

wherein said plurality of grounded end portions are connected to said ground electrode on different end surfaces of the substrate, respectively.

* * * * *